US005858260A

United States Patent [19]

Daussan et al.

[11] Patent Number: 5,858,260

[45] Date of Patent: Jan. 12, 1999

[54] MOLTEN METAL POURING CONTAINER AND PREFABRICATED SLEEVE FOR FIXING A NOZZLE IN A CONTAINER OF THIS KIND

[75] Inventors: Jean-Charles Daussan, Metz; Gerard Daussan; Andre Daussan, both of Longeville-Les-Metz, all of France

[73] Assignee: Daussan & Compagnie, Woippy, France

[21] Appl. No.: 811,929

[22] Filed: Mar. 5, 1997

[51] Int. Cl.[6] ..... B22D 41/08

[52] U.S. Cl. ..... 222/602; 222/591

[58] Field of Search ..... 222/591, 594, 222/597, 602; 266/271, 236

[56] References Cited

U.S. PATENT DOCUMENTS

| | | | |
|---|---|---|---|
| 3,395,840 | 8/1968 | Gardner | 222/591 |
| 3,735,906 | 5/1973 | Zettlemoyer et al. | 222/567 |
| 4,177,943 | 12/1979 | Suzuki | 222/591 |
| 4,576,365 | 3/1986 | Daussan et al. | 266/236 |

FOREIGN PATENT DOCUMENTS

| | | | |
|---|---|---|---|
| 2119057 | 8/1972 | France . | |
| 2 396 610 | 2/1979 | France . | |
| 57-4375 | 1/1982 | Japan . | |
| 63-157756 | 6/1988 | Japan . | |
| 1363855 | 8/1974 | United Kingdom | 222/591 |

*Primary Examiner*—Scott Kastler
*Attorney, Agent, or Firm*—Young & Thompson

[57] ABSTRACT

A prefabricated sleeve is adapted to be used in a molten metal pouring container comprising at least one pouring orifice in the form of a substantially frustoconical hole into which a pouring nozzle is inserted axially. The sleeve is inserted into an annular space formed between the hole and the outside of the nozzle for fixing the nozzle into the hole. The sleeve is prefabricated from inorganic particles bound together by a binder that has a predetermined rate of deterioration at the temperatures present during pouring of the molten metal.

10 Claims, 1 Drawing Sheet

MOLTEN METAL POURING CONTAINER AND PREFABRICATED SLEEVE FOR FIXING A NOZZLE IN A CONTAINER OF THIS KIND

BACKGROUND OF THE INVENTION

1. Field of the Invention

The present invention concerns a molten metal pouring container comprising lateral walls and a bottom covered with a permanent refractory lining, the bottom comprising at least one pouring orifice in the permanent lining of said bottom, this orifice being a substantially frustoconical hole in which a pouring nozzle is axially inserted, an annular space being provided between the hole in the permanent lining and the outside of the nozzle.

2. Description of the Prior Art

A container of this kind may be a molten metal pouring container such as a pouring ladle or a transfer container such as a pouring distributor.

The permanent lining and more importantly the pouring nozzle are made from a very hard refractory material.

In the conventional way, the pouring nozzle is joined by a layer of refractory cement to the surface of the frustoconical hole of a nozzle seating block inserted into the permanent lining or to the surface of a frustoconical hole formed directly in the permanent lining.

At the end of pouring it is necessary to detach the nozzle from the hole in the nozzle seating block or from the permanent lining in order to replace it with a new nozzle since it is practically blocked by slag adhering to its surface.

A ram which pushes the nozzle towards the interior of the container is used for this purpose.

This damages the surface of the frustoconical hole in the nozzle seating block. Because of this, the nozzle seating block must be replaced by a new block after each pouring operation, which is time-consuming and costly. The same applies if the hole is formed directly in the permanent lining.

FR-A-2 119 057 describes a container for iron and steel in which the annular space between the hole in the lining and the perimeter of the nozzle is thin (a few millimeters thick at most) and is filled with a highly refractory fibrous material that reacts only very slightly if at all with the materials of the surfaces of the joint. This fibrous material is preferably fused kaolin in fibrous form.

This solution requires difficult and unpleasant manual work in an environment that is unfavorable because of the heat, to make a guaranteed molten metal tight joint with the guaranteed safety required of a joint of this kind.

An object of the present invention is to remedy these drawbacks.

SUMMARY OF THE INVENTION

The invention consists in a prefabricated sleeve adapted to be used in a molten metal pouring container comprising at least one pouring orifice in the form of a substantially frustoconical hole into which a pouring nozzle is inserted axially, said sleeve being adapted to be inserted into an annular space formed between said hole and the outside of said nozzle for fixing said nozzle into said hole, said sleeve being prefabricated from inorganic particles bound together by a binder that has a predetermined rate of deterioration at the temperatures present during the pouring of said molten metal.

The prefabricated sleeve is easy to fit. It is also easy to make it to the required size so that it is a precise, sure and reliable fit to the surface of the hole in the container and to the outside surface of the nozzle.

Given that the binder has a predetermined rate of deterioration at the temperatures occurring during pouring of the molten metal, the sleeve loses a predetermined part of its cohesion during said pouring and is easily separated from the permanent refractory lining without damaging the surface of the frustoconical hole in the latter after pouring.

Thus it is no longer necessary to replace the nozzle seating block or to make good the frustoconical hole in the permanent lining after each pouring operation. To the contrary, this hole does not require any work over a very large number of successive pouring operations, with the result that pouring operations can follow on in virtually uninterrupted succession.

In one beneficial version of the invention, the particle sizes and the composition of the inorganic particles constituting the sleeve are chosen so that at the temperature of the molten metal contained in the container the particles are sintered incompletely or weakly, to produce a friable bond to the surfaces with which they are in contact.

There is therefore no risk of the particles of the sleeve adhering strongly to the surface of the hole in the permanent lining and they can be easily detached from this surface without damaging it.

Also, this incomplete or weak sintering maintains some cohesion of the inorganic particles to each other even if the binder disappears completely. Thus the sleeve is totally molten metal tight.

In one advantageous version of the invention the inorganic particles constituting the sleeve are principally particles of magnesia and/or silica.

The sleeve is therefore simple and inexpensive to manufacture.

In a preferred version of the invention the prefabricated sleeve is between 15 mm and 35 mm thick and thermally insulative.

The sleeve therefore exercises a separation and spacing function between the pouring nozzle and the permanent refractory lining. It also provides a thermal insulation function between the nozzle and said lining.

Thus the sleeve prevents cooling of the nozzle by the permanent lining during the pouring operation, which reduces the risk of the metal becoming fixed to the inside surface of the nozzle.

The invention also proposes a molten metal pouring container comprising lateral walls and a bottom covered with a refractory permanent lining, said bottom incorporating at least one pouring orifice in its permanent lining, said orifice being a substantially frustoconical hole in which a pouring nozzle is axially inserted, an annular space being formed between said hole in said permanent lining and the outside of said nozzle and said annular space being filled with a prefabricated sleeve.

Other features and advantages of the invention will emerge from the following description given by way of non-limiting example with reference to the accompanying drawings.

DETAILED DESCRIPTION OF THE PREFERRED EMBODIMENTS

Figure 1:
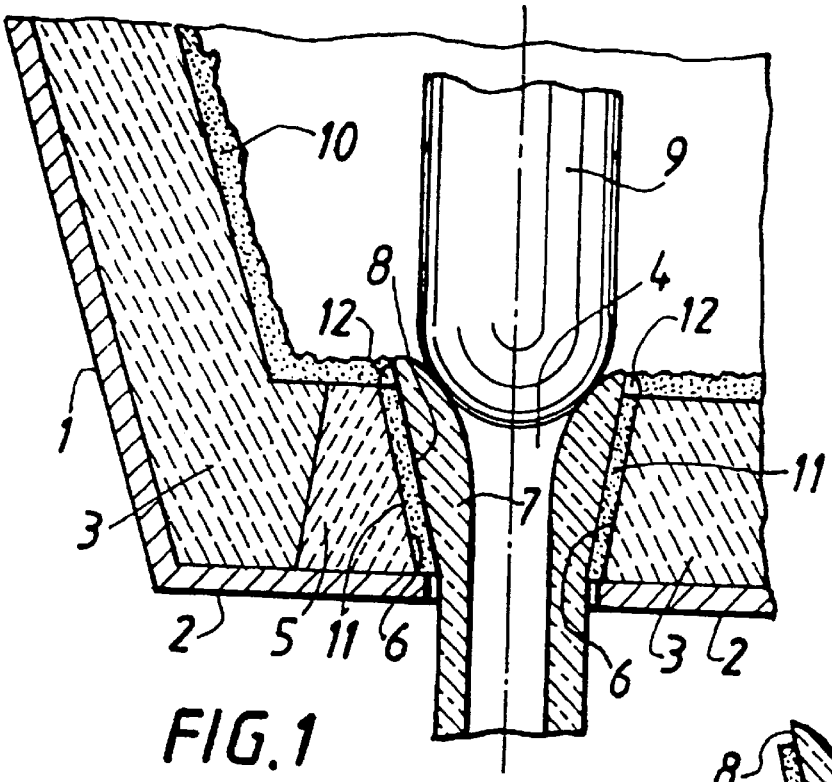
FIG. 1 is a part-sectional view of the bottom of a pouring container incorporating the improvements of the invention, in two embodiments shown by the right-hand and left-hand half-views, respectively.

FIG. 1 shows part of a pouring container, for example continuous casting tundish, comprising a lateral wall 1 and a bottom wall 2 covered with a permanent lining 3 of refractory concrete, for example. In the right-hand half-view the bottom 2 has a pouring orifice 4 through the permanent lining 3 of the bottom 2. The permanent lining 3 incorporates a substantially frustoconical hole 6, shown here as diverging in the upward direction, by way of example, in which a pouring nozzle 7 is axially inserted.

In the left-hand half-view the bottom 2 includes a pouring orifice 4 through a nozzle seating block 5 inserted into the permanent lining 3 of the bottom 2, the hole 6 passing through the nozzle seating block 5 and receiving the nozzle 7.

An annular space is formed between the hole 6 in the permanent lining 3, or the nozzle seating block 5 and the outside 8 of the nozzle 7.

To this end the nozzle 7 has an external surface 8 that is preferably of frustoconical shape substantially identical to the frustoconical interior shape of the hole 6.

If necessary, the pouring container contains a pouring stopper rod 9 which closes off the opening 4 through the nozzle 7.

The interior surface of the permanent lining 3 can be covered with a protective layer 10 of a consumable material, for example a sinterable material (inorganic particles, fibers and binder).

In accordance with the invention, the annular space formed between the hole 6 in the permanent lining 3 or the nozzle seating block 5 and the outside 8 of the nozzle 7 is filled with a prefabricated sleeve 11 made of inorganic particles held together by a binder or a bond having a predetermined rate of deterioration at the temperatures present during pouring of the molten metal.

This means that after the pouring operation the inorganic particles are only weakly or incompletely joined together. Thus the sleeve 11 retains sufficient cohesion to provide a totally molten metal tight joint during pouring, but has some degree of friability, which means that the fragments of the sleeve can be easily detached from the inside surface of the hole 6.

In one embodiment, the particle sizes and the composition of the inorganic particles are chosen so that, at the temperature of the molten metal contained in the container, the particles are incompletely sintered or only weakly sintered so as to create a weak bond with the surfaces with which they are in contact.

Thus the sleeve adheres only weakly to the surfaces with which it is in contact and remains friable.

The inorganic particles constituting the sleeve can be principally particles of magnesia and/or silica.

In this case, a conventional mineral and/or organic binder can be used that breaks down at the temperatures present during pouring, the incomplete or weak sintering of the particles maintaining the necessary cohesion of the sleeve 11.

A different type of binder or bond known in itself could be used having a predetermined rate of deterioration after pouring enabling easy removal of the sleeve 11 and the nozzle 7 to free the hole without damaging the interior surface of the hole 6.

The composition and the particle sizes of the inorganic particles can be chosen so that the sleeve has an apparent porosity greater than 45% and accordingly has thermal insulation properties.

The composition by weight of the mixture constituting the sleeve 11 may be as follows:

| | |
|---|---|
| silicate | 0%–20% |
| granular refractory material, for example ground clay, chamotte, olivine, magnesia and mixtures thereof | 0%–98% |
| mineral fibers | 0%–1% |
| organic fibers | 0%–2% |
| organic binder, for example dextrine | 0%–10% |
| rheological agent, for example bentonite | 0%–5% |

A preferred composition by weight of the mixture constituting the sleeve 11 is, for example:

| | | | |
|---|---|---|---|
| $Cr_2O_3$ | 0.12%–0.50% | for example | 0.25% |
| $SiO_2$ | 18%–22% | | 19.22% |
| $Al_2O_3$ | 0.10%–0.40% | | 0.28% |
| CaO | 1%–3% | | 2.00% |
| MgO | 60%–75% | | 68.32% |
| $Fe_2O_3$ | 1.20%–4% | | 2.82% |
| $Na_2O$ | 0%–0.10% | | 0.01% |
| $H_2O$ | 0.50%–2.50% | | 1.79% |
| C | 1.7%–3% | | 2.43% |
| loss on ignition at 1000° C. | 3%–5.5% | | 4.81% |

The thickness of the annular space filled by the sleeve 11 may be between about 15 mm and 35 mm.

At the end of pouring, the sleeve 11 remains friable, which means that the sleeve 11 has been incompletely sintered or has been only weakly sintered, because of the high temperature of the molten metal contained in the pouring container.

Thus the mechanical connection between the nozzle 7 and the surface of the hole 6 remains relatively weak. Thus the nozzle 7 can be easily extracted from the hole 6, simply by turning over the pouring container.

The connection produced by the weak or incomplete sintering between the sleeve 11 and the surfaces in contact is nevertheless sufficiently strong to prevent all risk of displacement of the nozzle by the effect of turbulence generated in the molten metal during pouring.

The incomplete sintering of the sleeve 11 also helps to make the sleeve totally molten metal tight, to prevent all risk of leakage of molten metal.

If the sleeve 11 were to remain in the powder state, the metal could infiltrate into it, which could have catastrophic consequences.

If the sleeve 11 were to be completely sintered, very strong bonds would be created between the surface of the hole 6 and the exterior of the nozzle and in this case the latter would be difficult to extract, as in the prior art.

The incomplete sintering is obtained by selecting for the sleeve 11 a mixture of inorganic particles such as silica, alumina or magnesia the particle sizes of which are not too fine, as this favors sintering.

After extracting the nozzle 7 the surface of the hole 6 is totally intact and ready to receive a new nozzle for further pouring of molten metal.

The thickness of the sleeve 11 provides a physical separation and spacing function between the pouring nozzle 7 and the permanent lining 3 or the nozzle seating block 5. It therefore eliminates all the consequences of thermal expansion of the nozzle during pouring and of mechanical removal of the nozzle after pouring.

The sleeve 11 preferably has an apparent porosity greater than 45%, giving it thermal insulation properties. This apparent porosity can result in particular from the decomposition of the mineral and/or organic binder and from that of any organic fibers.

Because of this, and because of its relatively great thickness, the sleeve 11 provides significant thermal insulation between the nozzle and the permanent lining. This prevents any loss of heat from the nozzle to the permanent lining and therefore enables rapid heating of the nozzle prior to pouring and less cooling of the nozzle during pouring. The composition of the sleeve 11 must be such that the sleeve does not adhere to the surface of the hole 6 in the permanent lining at the temperature of that surface. On the other hand, it is no problem if the sleeve adheres to the nozzle 7, the temperature of which is significantly higher than that of the permanent lining.

Because of its precise dimensions with close tolerances, the prefabricated sleeve enables rapid and precise fitting of the nozzle into the hole 6.

Figure 2:
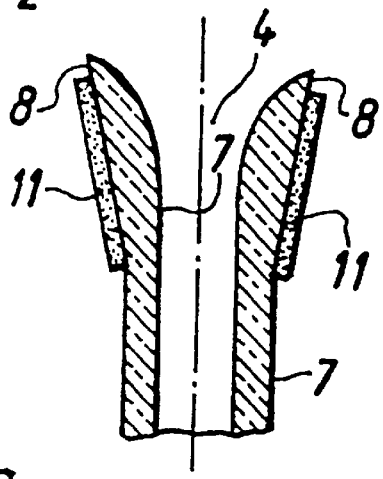
FIG. 2 shows a detail from FIG. 1 representing the pouring nozzle to the outside peripheral face of which the prefabricated sleeve of the invention is fixed.

In particular, and as shown in FIG. 2, it is advantageous to fix the sleeve 11, using refractory adhesive or mortar, to the exterior surface of the nozzle 7 before fitting the latter into the hole 6 in the pouring container.

This facilitates the fast and precise fitting of the nozzle 7 into the hole 6 and does not require any adjustments or the use of mortar or adhesive.

An annular seal 12 of refractory cement may be disposed around the upper part of the nozzle 7, above the sleeve 11, to protect the sleeve 11.

Figure 3:
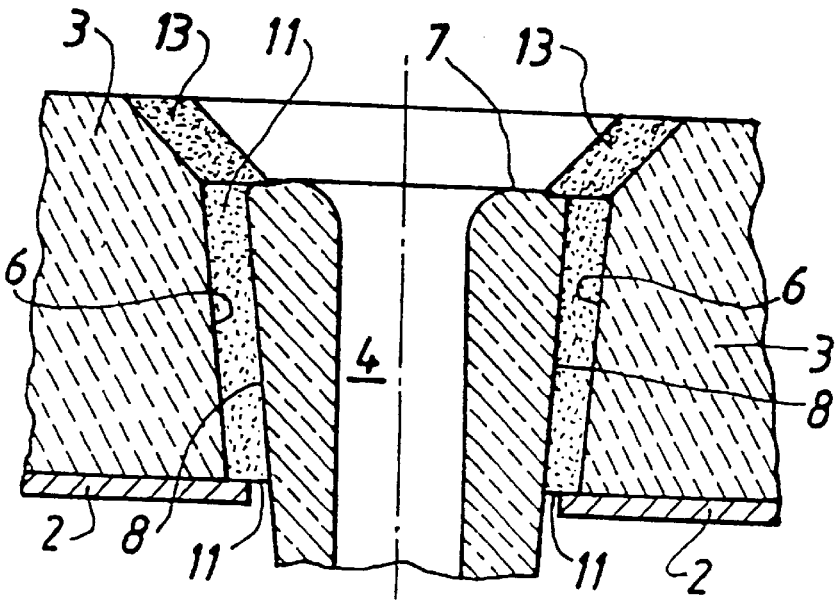
FIG. 3 is a view to a larger scale of a detail of FIG. 1 in a different embodiment of the invention.

In the FIG. 3 embodiment, an insulative ring 13 having the same composition and the same physical and thermal characteristics as the sleeve 11, for example, is fitted to the sleeve 11, the nozzle 7 and the permanent lining 3 from above. The ring 13 is preferably prefabricated like the sleeve 11.

Of course, the invention is not limited to the example just described and many modifications may be made to the latter without departing from the scope of the invention.

For example, the exterior surface of the nozzle 7 could incorporate raised or recessed patterns to achieve some anchoring of the sleeve 11 to the surface of the nozzle 7 so that on extraction of the latter the sleeve 11 is simultaneously removed from the hole 6 and therefore leaves the surface of the hole smooth and intact.

There is claimed:

1. A prefabricated sleeve adapted to be used in a molten metal pouring container comprising at least one pouring orifice in the form of a substantially frustoconical hole into which a pouring nozzle is inserted axially, said sleeve being adapted to be inserted into an annular space formed between said hole and the outside of said nozzle fixing said nozzle into said hole, said sleeve being prefabricated from inorganic particles, wherein said inorganic particles are bound together by a binder having a deterioration rate for the temperatures present during the pouring of said molten metal, said deterioration rate being chosen so that after the pouring operation, said inorganic particles are incompletely joined together in order to enable an easy removal of said sleeve and of said nozzle from said hole without damaging the interior surface of said hole, and said inorganic particles having composition and size selected such that at said temperatures present during the pouring of said molten metal contained in said container, said particles are incompletely sintered so as to create a friable bond to the surfaces with which said sleeve contacts.

2. The sleeve claimed in claim 1 wherein said inorganic particles constituting said sleeve are principally chosen from the group consisting of magnesia and silica.

3. The sleeve claimed in claim 1 wherein said prefabricated sleeve is between approximately 15 mm and approximately 35 mm thick.

4. The sleeve claimed in claim 1 wherein said prefabricated sleeve is made from a mixture having the following composition by weight:

| | |
|---|---|
| mineral binder | 0%–20%, |
| granular refractory material | 0%–98%, |
| mineral fibers | 0%–1%, |
| organic fibers | 0%–2%, |
| organic binder | 0%–10%, |
| rheological agent | 0%–5%, |

wherein the total of said composition is equal to 100%.

5. A sleeve as claimed in claim 1 having an apparent porosity greater than 45% whereby said sleeve exhibits increased thermally insulative properties.

6. An assembly comprising:

a nozzle adapted to be placed within a molten metal pouring container pouring orifice and having an exterior surface contoured to the shape of said orifice; and a prefabricated sleeve fixed to the exterior surface of said nozzle, said sleeve being prefabricated from inorganic particles, wherein said inorganic particles are bound together by a binder having a deterioration rate for the temperature present during the pouring of said molten metal, said deterioration rate being chosen so that after the pouring operation, said inorganic particles are incompletely joined together in order to enable an easy removal of said sleeve and of said nozzle from said hole without damaging the interior surface of said hole, and said inorganic particles having composition and size selected such that at said temperatures present during the pouring of said molten metal contained in said container, said particles are incompletely sintered so as to create a friable bond to the surfaces with which said sleeve contacts.

7. A molten metal pouring container comprising lateral walls and a bottom covered with a refractory permanent lining, said bottom incorporating at least one pouring orifice in its permanent lining, said orifice being a substantially frustoconical hole in which a pouring nozzle is axially inserted, an annular space being formed between said hole in said permanent lining and the outside of said nozzle and said annular space being filled with a prefabricated sleeve, said sleeve being prefabricated from inorganic particles, wherein said inorganic particles are bound together by a binder having a deterioration rate for the temperature present during the pouring of said molten metal, said deterioration rate being chosen so that after the pouring operation, said inorganic particles are incompletely joined together in order to enable an easy removal of said sleeve and of said nozzle from said hole without damaging the interior surface of said hole, and said inorganic particles having composition and size selected such that at said temperatures present during the pouring of said molten metal contained in said container, said particles are incompletely sintered so as to create a friable bond to the surfaces with which said sleeve contacts.

8. A container as claimed in claim 7 wherein a prefabricated insulative ring is placed over said sleeve, said nozzle and said permanent refractory lining from above.

9. The sleeve as claimed in claim 4, wherein the composition by weight of said sleeve mixture from which said prefabricated sleeve is made is as follows:

| | |
|---|---|
| $Cr_2O_3$ | 0.12%–0.50% |
| $SiO_2$ | 18%–22% |
| $Al_2O_3$ | 0.10%–0.40% |
| CaO | 1%–3% |
| MgO | 60%–75% |
| $Fe_2O_3$ | 1.20%–4% |
| $Na_2O$ | 0%–0.10% |
| $H_2O$ | 0.50%–2.50% |
| C | 1.7%–3% |
| loss on ignition at 1000° C. | 3%–5.5%. |

10. The sleeve claimed in claim 9, wherein the composition by weight of said mixture from which said prefabricated sleeve is made is as follows:

| | |
|---|---|
| $Cr_2O_3$ | 0.25% |
| $SiO_2$ | 19.22% |
| $Al_2O_3$ | 0.28% |
| CaO | 2.00% |
| MgO | 68.32% |
| $Fe_2O_3$ | 2.82% |
| $Na_2O$ | 0.01% |
| $H_2O$ | 1.79% |
| C | 2.43% |
| loss on ignition at 1000° C. | 4.81%. |

* * * * *